United States Patent [19]

Gruzensky

[11] Patent Number: 4,601,418

[45] Date of Patent: Jul. 22, 1986

[54] WRIST POCKET PROCESS

[76] Inventor: Terrell Gruzensky, 6520 Arizona Ave., Los Angeles, Calif. 90045

[21] Appl. No.: 284,695

[22] Filed: Jul. 20, 1981

[51] Int. Cl.[4] ..... A45C 1/06

[52] U.S. Cl. ..... 224/222; D2/383; D3/59

[58] Field of Search ..... 224/222, 219, 224, 228, 224/229; D3/59; D2/383, 402, 59

[56] References Cited

U.S. PATENT DOCUMENTS

| | | | |
|---|---|---|---|
| D. 255,509 | 6/1980 | Nathan et al. | D2/383 |
| 2,001,954 | 5/1935 | Buxton | D3/59 X |
| 3,670,933 | 6/1972 | Jones | 224/222 |
| 4,332,338 | 6/1982 | Christiansen | 224/222 |

*Primary Examiner*—Steven M. Pollard
*Attorney, Agent, or Firm*—Keith D. Beecher

[57] ABSTRACT

A zippered pocket for money, keys, identification cards, and other personal items, which is constructed to be worn on the wrist or ankle. The pocket is particular useful for joggers. The embodiment to be described has a terry cloth backing which may be wrapped comfortably around the wrist, and it has Velcro closures. The pocket, in the embodiment to be described, is formed of light machine-washable durable nylon cloth. However, it will become evident as the description proceeds that the pocket may be made from a variety of materials. A process is also disclosed by which the pocket may be manufactured expeditiously and inexpensively.

8 Claims, 8 Drawing Figures

WRIST POCKET PROCESS

BACKGROUND OF THE INVENTION

The pocket of the invention is of the same general type as is disclosed in U.S. Pat. No. 3,670,933. The pocket described in the patent is a container for currency, which is formed of a stretchable fabric constructed to encircle the arm or leg of the wearer. However, the pocket of the present invention is constructed differently from the pocket described in the patent, and is of more general utility as a container for a variety of personal items. The pocket of the invention is constructed in such a manner as to permit its manufacture inexpensively, by means of a unique manufacturing process, which is also disclosed herein.

DETAILED DESCRIPTION OF THE ILLUSTRATED EMBODIMENT

Figure 1:
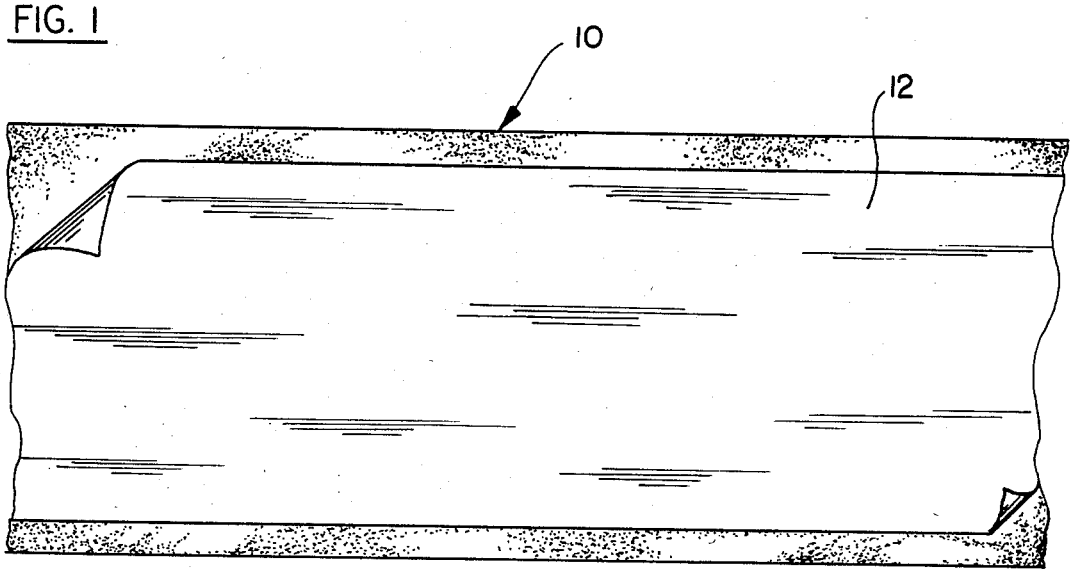
FIGS. 1–8 shows the pocket of the present invention in its various configurations from the initial step of its manufacturing process to the final product.

As a first step in the manufacturing process, and as shown in FIG. 1, a continuous strip of terry cloth 10 is provided to form a backing member for the pocket, and a continuous strip of a stiffener fabric 12 is adhesively attached to the terry cloth. The stiffener fabric may be any appropriate synthetic fibrous material, such as is presently marketed under the trademark "Pellon", and which is in general use as a stiffener for shirt collars. The use of the stiffener material permits the side edges of the terry cloth to be folded over in an appropriate folding machine in a subsequent step of the process, without jamming, prior to stitching, as will be described.

Figure 2:
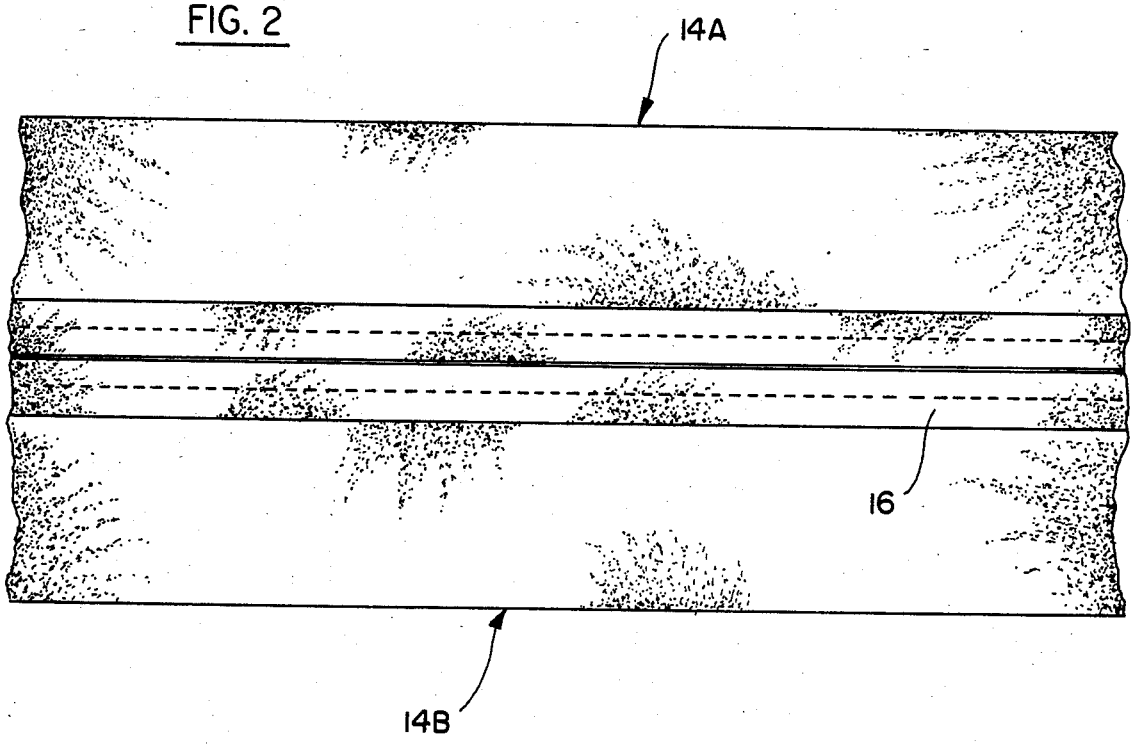

As a second step in the process, and as shown in FIG. 2, a continuous strip of a zipper member 16 is provided which includes, for example, two rows of the usual zipper teeth, and appropriate fabric attached to each row to permit the zipper to be mounted on the product on which it is to be used. In accordance with the process of the invention, a continuous strip of such a zipper member 16 is provided, and it is sewn to two continuous strips 14A and 14B of, for example, nylon cloth such as "Cire" so as to provide the outer member of the pocket.

Figure 3:
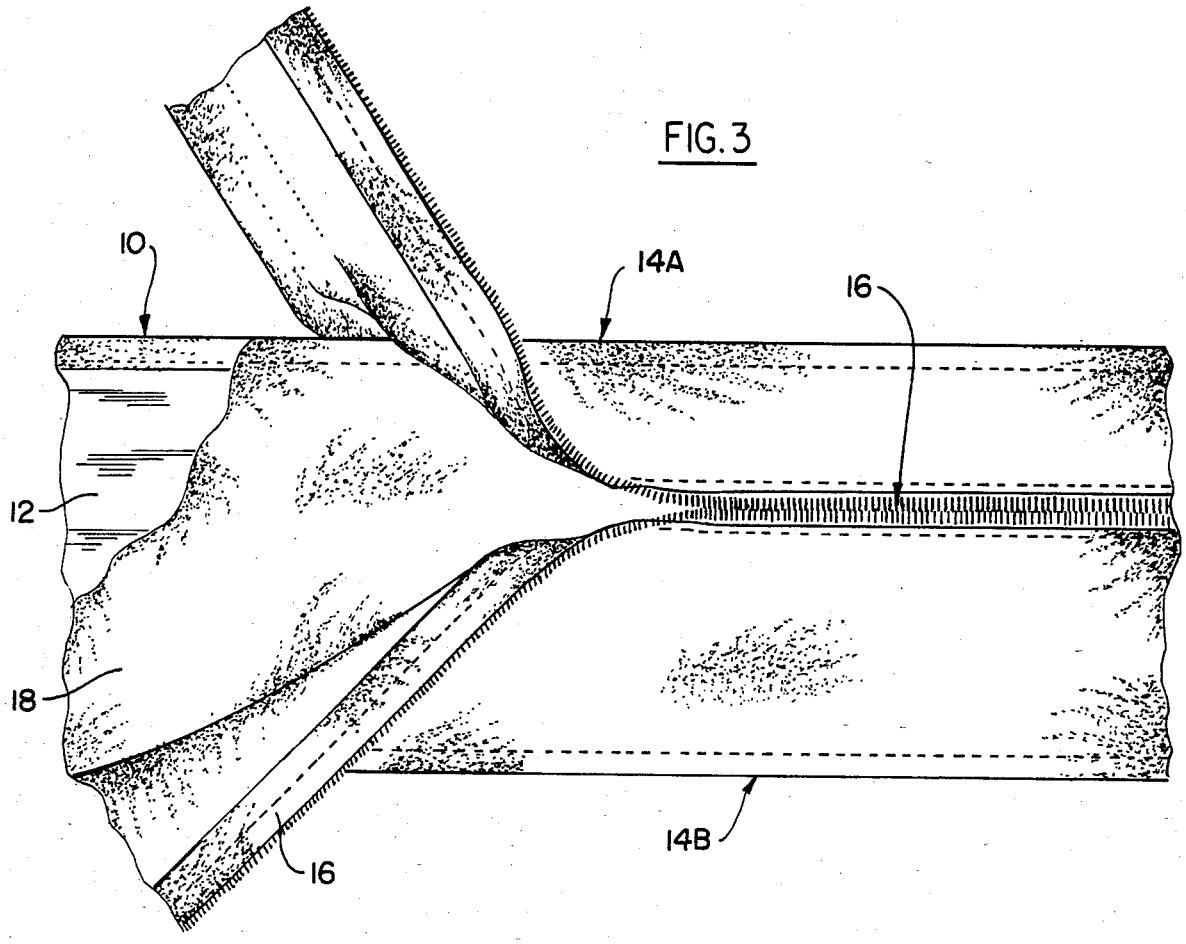

As a next step in the process, and as shown in FIG. 3, a third continuous strip of nylon cloth 18, or other appropriate material, such as Cire is provided to form an inner member for the pocket, and strips 10, 16, 14A, 14B and 18 are placed on top of one another as shown in FIG. 3. The side edges of each of the three strips are folded inwardly in an appropriate folding machine, and the continuous strips are drawn through a sewer so that the edges of the three strips may be sewn together.

Figure 4:
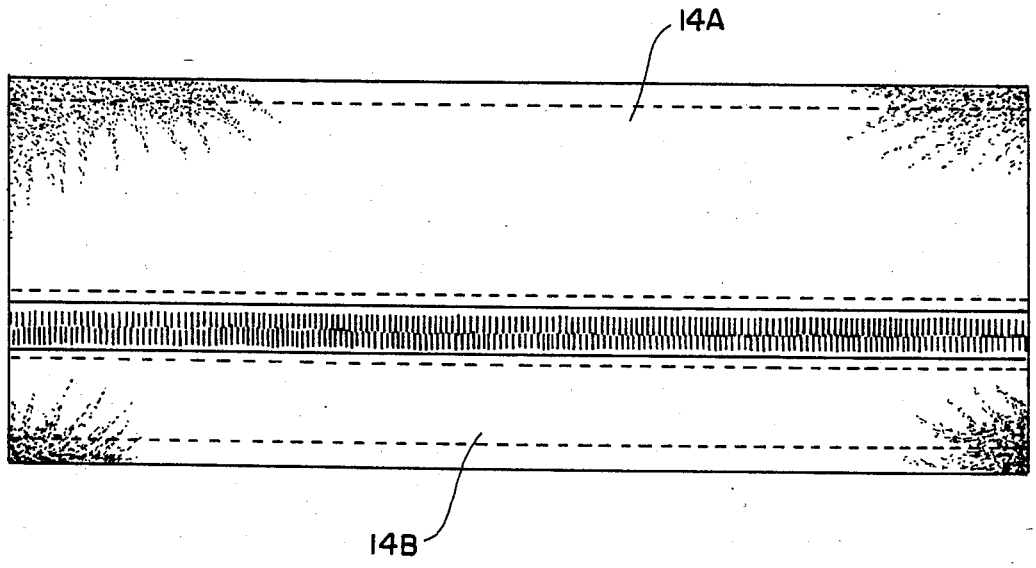
Figure 5:
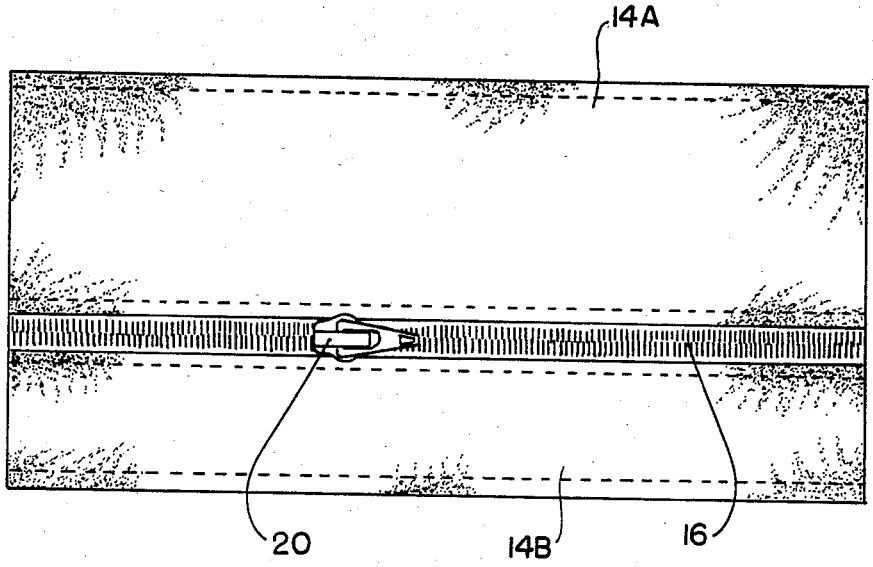

The resulting continuous strip is then cut into individual items, each of a predetermined length, as shown in FIG. 4. Then, and as shown in FIG. 5, a slider 20 is inserted into the zipper 16.

Figure 6:
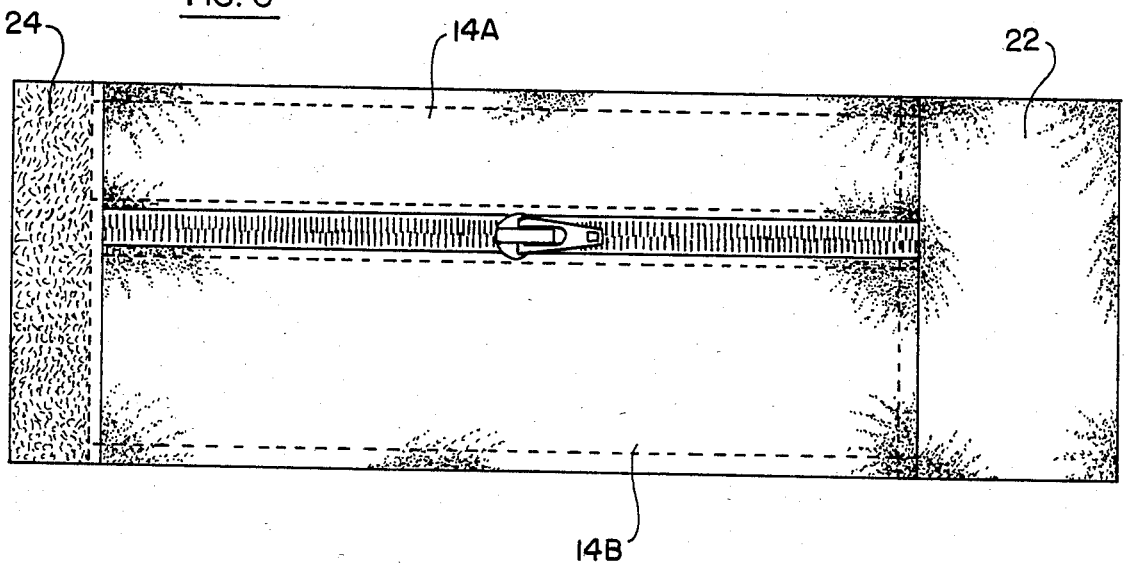
Figure 7:
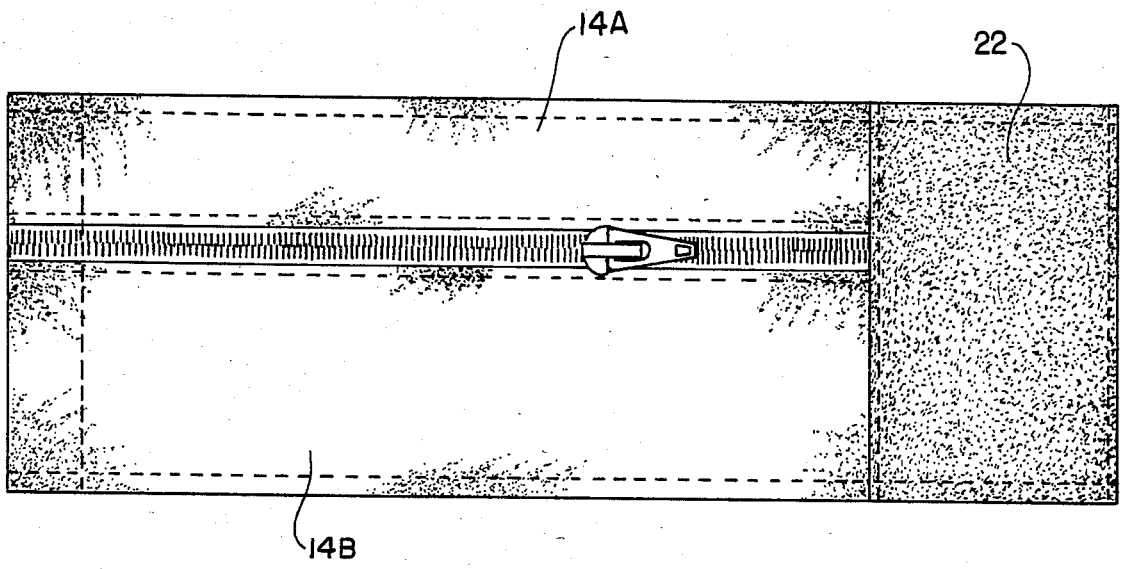
Figure 8:
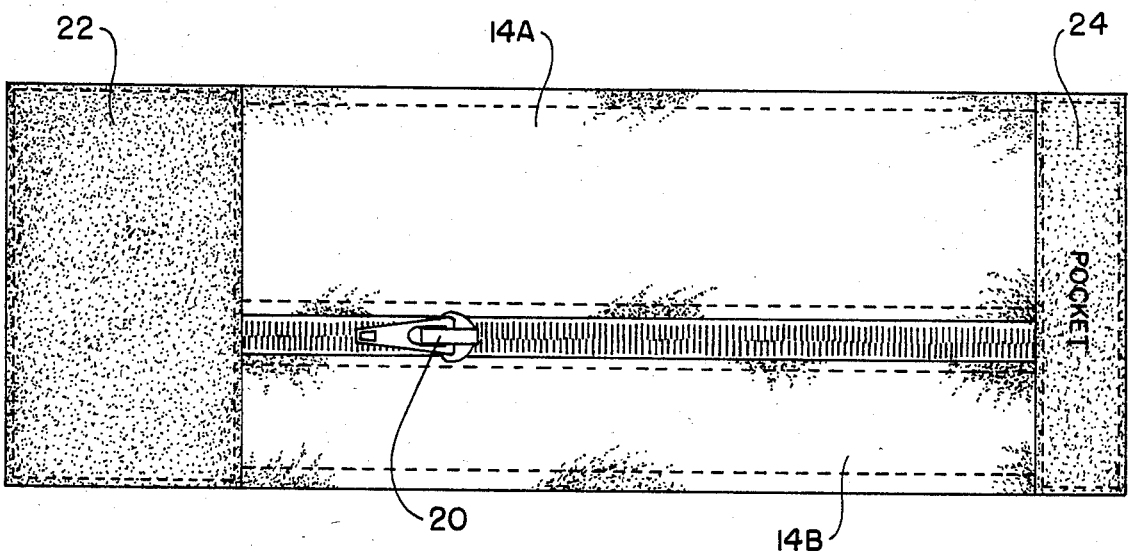

A first Velcro member 22 is then sewn to one end of the item, as shown in FIG. 6; and a second Velcro member 24 is sewn to the other end. The Velcro member 22 is folded back over the outer member 14A, 14B and zipper member 16 to the position shown in FIG. 7, and Velcro member 24 is folded over the backing member, at the other end of the item.

As a final step in the process, an appropriate label may be sewn over the outer member 14A, 14B on the opposite side from the Velcro member 24. As a final step, the product is trimmed, a hang tag is placed on the zipper slider 20, and the product is ready for market.

To use the product, the zipper is opened, and personal items are placed within the pocket. Then, the zipper is closed, and the pocket is wrapped around the arm or leg of the wearer, so that the Velcro members 22 and 24 engage and lock with one another to hold the pocket firmly in place.

The invention provides, therefore, an improved pocket of a simple construction which enables it to be manufactured expeditiously and inexpensively. The invention also provides an improved manufacturing process for fabricating the pocket.

It will be appreciated that while particular embodiments of the invention have been shown and described, modifications may be made, and it is intended in the claims to cover all modifications which come within the true spirit and scope of the invention.

What is claimed is:

1. A process for making an elongated flexible rectangular-shaped pocket to be worn on the arm or leg of the wearer, comprising the following steps: (a) providing a continuous strip of a selected flexible fabric to form a backing member for the pocket; (b) providing a continuous strip of a selected flexible fabric to form an inner member of the pocket; (c) providing a continuous strip of a zipper member; (d) attaching two continuous strips of a selected flexible fabric material on either side of the zipper member to form an outer member of the pocket; (e) placing the continuous backing member, the inner member and the outer member on top of one another and attaching the respective side edges of the members to one another; (f) cutting the resulting assembly to provide a plurality of units each of a predetermined length; (g) attaching a first Velcro member over one end of each of the units; and (h) attaching a second Velcro member to the other end of each of the units.

2. The process defined in claim 1, in which said first Velcro member is folded back over a portion of the outer member and zipper member adjacent to said one end, and is then attached thereto.

3. The process defined in claim 1, in which said second Velcro member is folded back over a portion of the backing member adjacent to said other end and then attached thereto.

4. The process defined in claim 1, in which said zipper member is attached to said two continuous strips by sewing.

5. The process defined in claim 1, in which said backing member, inner member and outer member are sewn to one another along the respective side edges thereof.

6. The process defined in claim 1, in which the backing member is terry cloth, and which includes the step of adhesively attaching a continuous strip of stiffener fabric to the backing member prior to placing the backing member on top of the inner and outer members.

7. The process defined in claim 6, and which includes the step of folding the side edges of the backing member, inner member and outer member prior to sewing the respective side edges thereof.

8. The process defined in claim 5, and which includes the step of folding the side edges of the backing member, inner member and outer member prior to sewing the respective side edges thereof.

* * * * *